US007021252B2

(12) United States Patent
Warfel et al.

(10) Patent No.: US 7,021,252 B2
(45) Date of Patent: Apr. 4, 2006

(54) SAS PISTON CHANNEL FOR OPTIMUM AIR SCAVENGING

(75) Inventors: Paul A. Warfel, Texarkana, TX (US); Rodney W. Tynes, Shreveport, LA (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/792,995

(22) Filed: Mar. 4, 2004

(65) Prior Publication Data

US 2005/0193967 A1 Sep. 8, 2005

(51) Int. Cl.
*F02B 33/04* (2006.01)
*F02B 19/00* (2006.01)

(52) U.S. Cl. ..... 123/73 PP; 123/73 R

(58) Field of Classification Search ..... 123/73 PP, 123/73 AA, 65 R, 193.6
See application file for complete search history.

(56) References Cited

U.S. PATENT DOCUMENTS

| | | | | |
|---|---|---|---|---|
| 694,016 | A | 2/1902 | Hibbard et al. | |
| 887,237 | A | 5/1908 | Dunbar | |
| 1,550,703 | A | 8/1925 | Knott | |
| 1,755,260 | A | 4/1930 | Johnson | |
| 1,773,387 | A | 8/1930 | Busque | |
| 3,257,997 | A | 6/1966 | Sheaffer | |
| 6,497,204 | B1 * | 12/2002 | Miyazaki et al. | 123/73 PP |
| 6,564,760 | B1 | 5/2003 | Laydera-Collins | |
| 6,571,756 | B1 * | 6/2003 | Rosskamp et al. | 123/73 PP |

FOREIGN PATENT DOCUMENTS

| | | | |
|---|---|---|---|
| DE | 10229365 | A1 * | 1/2004 |
| JP | 2003343352 | A * | 12/2003 |

* cited by examiner

*Primary Examiner*—Henry C. Yuen
*Assistant Examiner*—Hyder Ali
(74) *Attorney, Agent, or Firm*—Pearne & Gordon LLP

(57) ABSTRACT

A piston channel is provided for a piston of an air scavenging internal combustion engine. The channel extends radially inward partially around a circumference of a piston body. An edge wall of the channel is sloped towards a wrist pin aperture in the piston to improve purging efficiency of a transfer duct.

7 Claims, 4 Drawing Sheets

10
26
14
12
38
19
28
18
16
40
44
30
32
42
34
36
22
20
41
41

SAS PISTON CHANNEL FOR OPTIMUM AIR SCAVENGING

FIELD OF THE INVENTION

The present invention relates to engines and more particularly, to a piston channel of an internal combustion engine.

BACKGROUND OF THE INVENTION

Small two-stroke engines enjoy widespread acceptance in the field of hand-held outdoor equipment due to performance advantages over competing technologies. The main issue with these engines is a potential for high hydrocarbon emissions. In traditional two-stroke engines, incoming fuel mixture (fuel and air) is used to help expel exhaust gases. With stratified scavenging, a fresh air charge is used to expel the exhaust gases. The result is lower emissions and lower fuel consumption.

In a stratified scavenging two-stroke internal combustion engine, an air supply is introduced into a combustion chamber of the engine after a combustion event has occurred and before a fuel mixture is delivered from a crankcase chamber of the engine. The air supply facilitates exhausting the combusted gas from the combustion chamber and provides some air to facilitate combustion of the subsequently delivered fuel mixture.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, an internal combustion engine is provided. The internal combustion engine includes a cylinder block; a piston housed and vertically slidable within the cylinder block; and a piston channel located on the piston. The piston channel includes an upwardly angled top edge wall.

In accordance with another aspect of the present invention, a piston is provided for an internal combustion engine. The piston includes a substantially cylindrical piston body; and a scavenging channel that extends circumferentially around a portion of the piston body and is shaped such that an upper wall of the scavenging channel is angled upward in a outward radial direction.

In accordance with yet another aspect of the present invention, an internal combustion engine provided that includes a cylinder block; a piston housed and vertically slidable within the cylinder block; and channel means having an angled top wall for purging a scavenging channel of the engine.

To the accomplishment of the foregoing and related ends, the invention then, comprises the features hereinafter fully described and particularly pointed out in the claims. The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

DETAILED DESCRIPTION OF THE INVENTION

Figure 1:
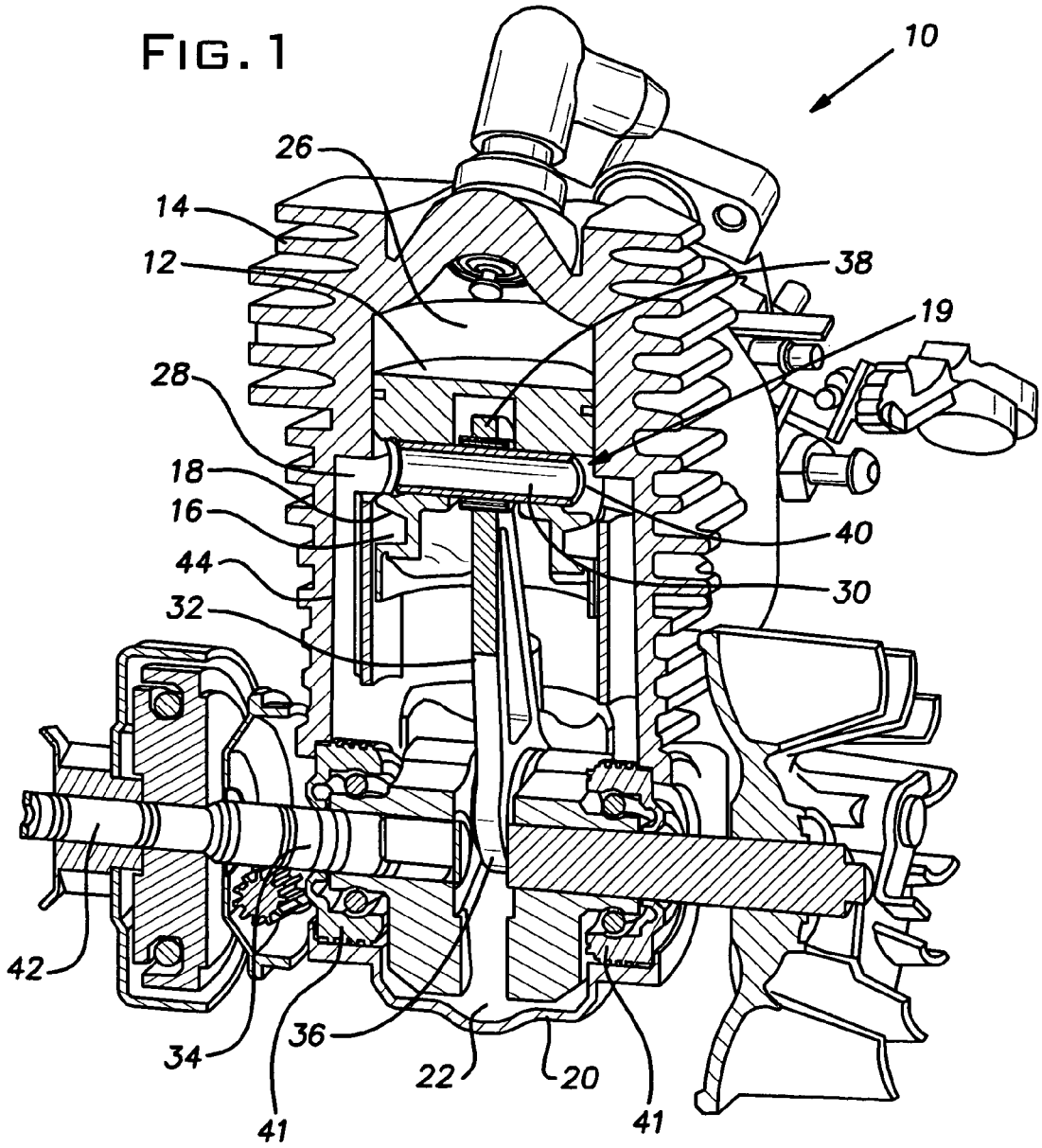
FIG. 1 illustrates a cross sectional view of a stratified scavenging two-stroke engine in accordance with an aspect of the present invention.

The present invention relates to a piston channel employed for improved purging of a transfer or scavenging passage. The present invention will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details. In other instances, well-known structures and devices are shown in block form in order to facilitate describing the present invention.

Referring initially to FIG. 1, a cross sectional view of a stratified scavenging two-stroke engine 10 is illustrated in accordance with an aspect of the present invention. In particular, FIG. 1 illustrates a cross section through a crankshaft axis and perpendicular to a cylinder axis. A piston 12 is housed and vertically slidable within a cylinder block 14 of the engine 10. The piston 12 includes a piston channel, or kidney, 16 wherein a portion of an edge wall 18 is angled, tapered, or otherwise sloped towards a wrist pin aperture 19 located in the piston 12. For example, the edge wall 18 can have a gradually increasing angle and can be angled from about ten degrees to about sixty degrees from an axis parallel to a centerline of the wrist pin aperture 19. It is contemplated that the angled edge wall 18 facilitates purging of the fuel mixture from a scavenging passage 44, thereby improving emissions output from the engine 10, as will be discussed below. However, it is to be appreciated that other airflow dynamics may help facilitate purging.

A crankcase 20 is coupled to an underside portion of the cylinder block 14, and a crank chamber 22 is formed in the crankcase 20. The piston 12 and the cylinder block 14 form a cylinder chamber, or combustion chamber, 26 to which a fuel mixture is fed to be ignited. Provided in a sidewall of the cylinder block 14 are an exhaust port (not shown), which is connected to an exhaust passage (not shown) for exhausting combustion gas after combustion, and a scavenging port 28 for supplying the fuel mixture to the combustion chamber 26. The exhaust port is coupled to a muffler (not shown) via an exhaust pipe (not shown) and the combustion gas is exhausted into the atmosphere as exhaust gas from the muffler.

A wrist pin 30 extends through the wrist pin aperture 19, such that the wrist pin 30 pivotally couples the piston 12 with a connecting rod 32. The connecting rod 32 is pivotally connected to a crankshaft 34 by a crankpin (not shown) and can rotate at both ends so that an angle of the connecting rod 32 can change as the piston 12 moves and the crankshaft 34 rotates. The connecting rod 32 includes a large end 36, which encircles rod journals, and a small end 38, which encircles the wrist pin 30. The wrist pin 30 extends transversely through the piston 12 and is secured to the piston 12 by a wrist pin boss 40. Bearings for the wrist pin 30 may be either in the piston 12, the connecting rod 32, or both. The crankshaft 34 is supported for rotation within the crankcase 22 via bearings 41. The crankshaft 34 is operable to deliver rotational force to a portion (e.g., a trimmer head drive shaft, a chainsaw drive shaft) of a power tool.

During operation of the engine 10, when the piston 12 begins to ascend from a bottom dead center position, the volume of the crankcase 22 increases. During the piston ascent, the piston 12 closes the exhaust port and the scavenging port 28. As a result, pressure inside the crankcase 22 and a scavenging passage 44 declines, drawing fuel-air mixture into the crankcase 22, and drawing air from an air passage 46 (FIG. 3), through the piston channel 16, into the scavenging passage 44 and then into the crankcase 22. When the piston 12 nears a top dead center position, the fuel-air mixture that was supplied to the combustion chamber 26 in the previous stroke ignites, and when the piston 12 begins to descend, the pressure inside the crankcase 22 rises. Meanwhile, opening the exhaust port and the scavenging port 28 exhausts the combustion gas inside the combustion chamber 26 to the exhaust passage. At substantially the same time, the air inside the scavenging passage 44 jets into the combustion chamber 26, exhausting the remaining combustion gas. The fuel-air mixture that was drawn into the crankcase 22 is supplied into the combustion chamber 26 via the scavenging passage 44 following the air. The piston 12 then reaches the bottom dead center.

Figure 2:
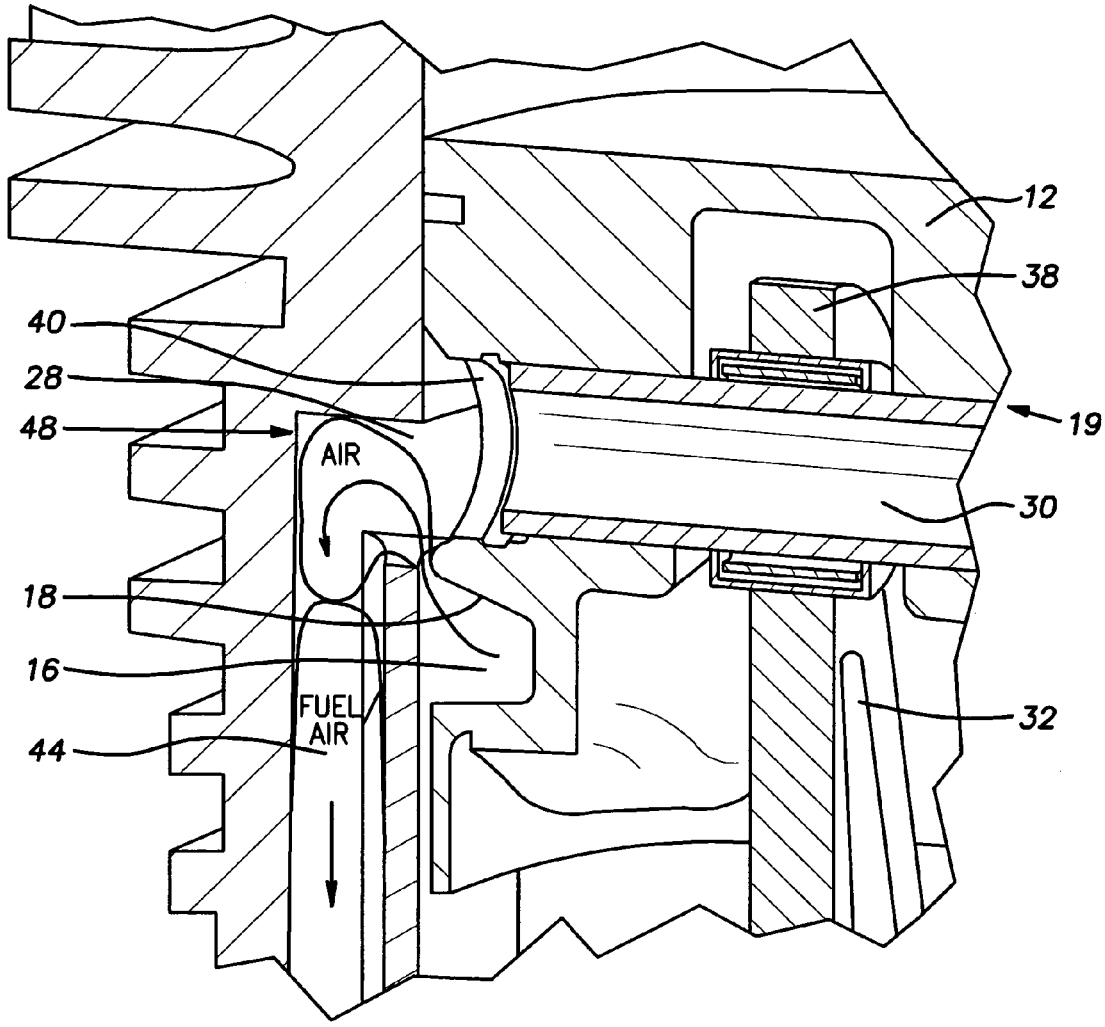
FIG. 2 illustrates an angled wall in relation to a transfer duct of a stratified scavenging two-stroke engine with a piston in a first position in accordance with an aspect of the present invention.
Figure 3:
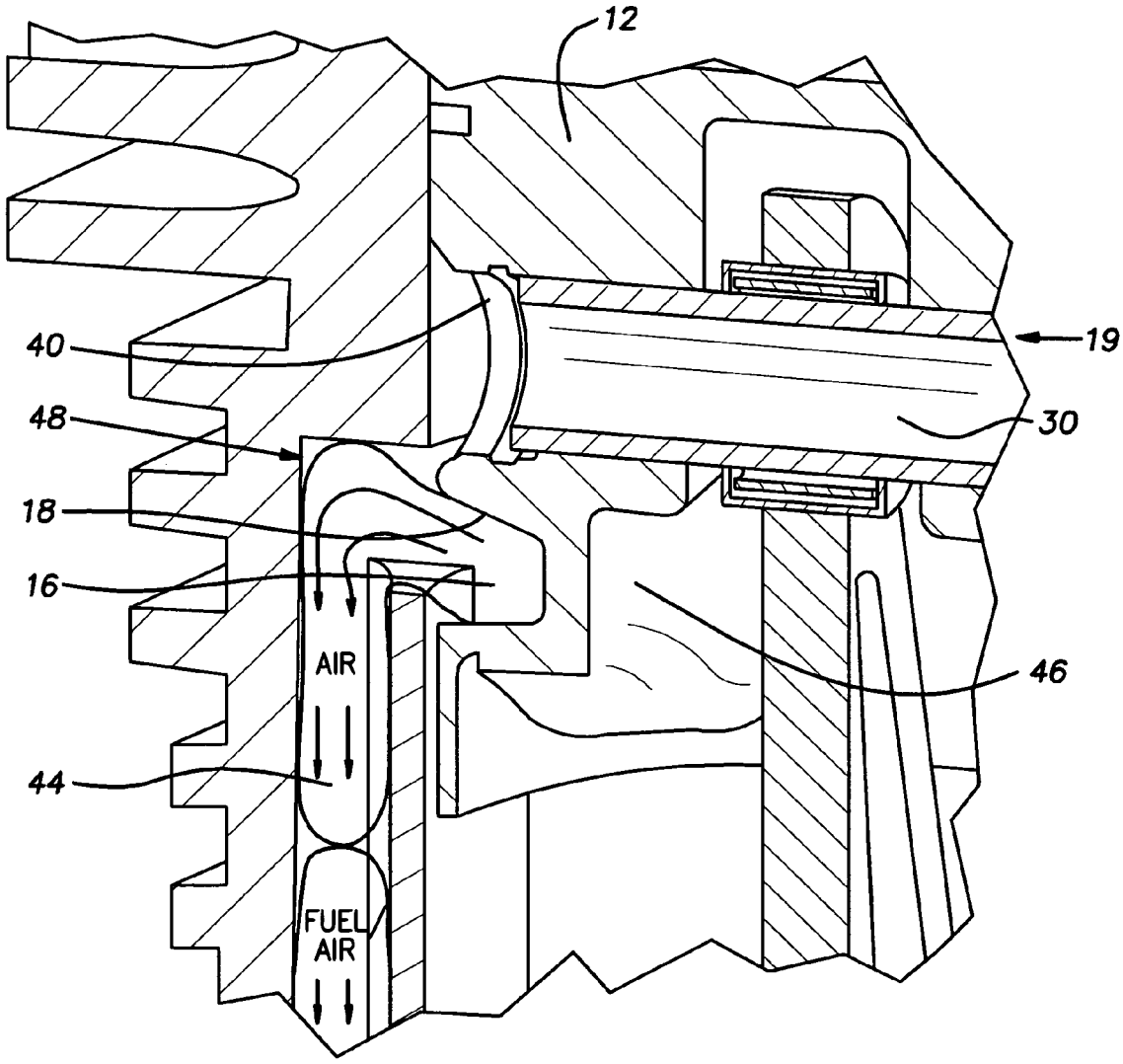
FIG. 3 illustrates an angled wall in relation to a transfer duct of a stratified scavenging two-stroke engine with a piston in a second position in accordance with an aspect of the present invention.

Turning now to FIGS. 2 and 3, enlarged views of the piston edge wall 18 in relation to the scavenging port 28 are shown with the piston 12 in first and second positions, respectively. In particular, FIGS. 2 and 3 illustrate an airflow pattern between the piston channel 16 and the scavenging passage 44 during ascent of the piston 12 in the cylinder block 14. In FIG. 2, the first piston position is such that the scavenging port 28 is first opened to the piston channel 16. When the piston channel 16 first opens, air enters the scavenging port 28 from the piston channel 16 and fuel mixture is forced out of the scavenging passage 44 back into the crankcase 22. The sloped edge wall 18 of the piston channel 16 increases the open time between the piston channel 16 and the scavenging port 28 while still allowing for support of the wrist pin boss 40.

In FIG. 3, the piston is depicted farther up in the total vertical travel. As shown in the example, the angled edge wall 18 in the piston 12 is directed towards a top portion 48 of the scavenging passage 44 when the piston 12 begins to open the passage 44. Accordingly, air from the piston channel 16 flows towards the top portion 48 prior to traveling down the scavenging passage 44. Directing the airflow to the top portion 48 facilitates forcing of remaining fuel mixture back down the scavenging passage 44 and into the crankcase 22. The more effective the scavenging passage 44 can be purged, the less unburned raw emissions results.

Figure 4:
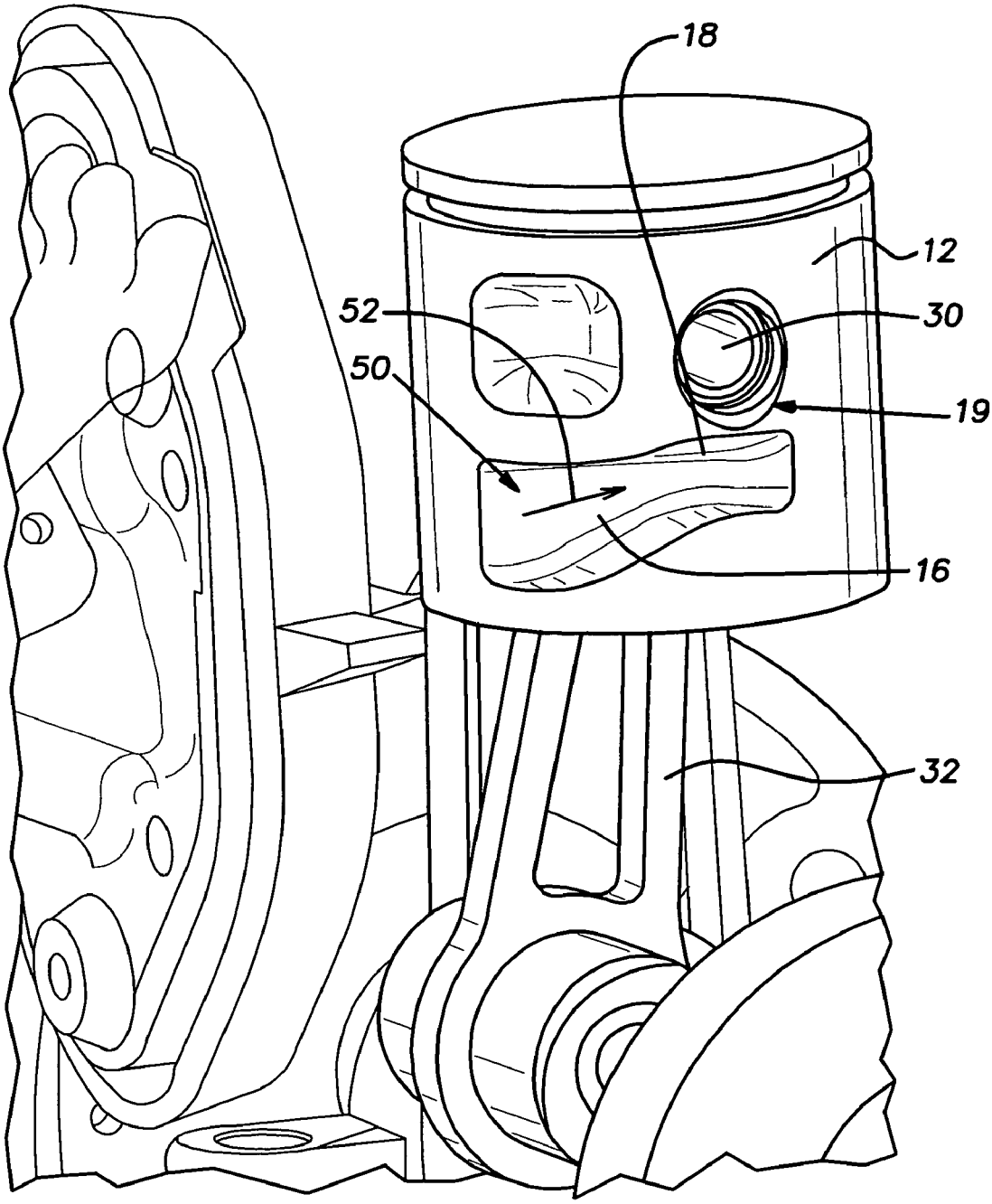
FIG. 4 illustrates a piston of a stratified scavenging two-stroke engine in accordance with an aspect of the present invention.

FIG. 4 illustrates the piston 12 from a side view with the cylinder block 14 removed. The piston 12 includes a substantially cylindrical body wherein the piston channel 16 extends partially around a circumferential periphery of the piston body. More specifically, the piston channel 16 extends radially inward partially around a circumference of the piston body such that the edge wall 18 is sloped upward in an outward radial direction. It is to be appreciated that the piston channel 16 can be of any suitable shape having an edge wall 18 that is sloped towards a wrist pin aperture 19 at the scavenging port 28 opening. The presence of the sloped edge wall 18 in the piston channel 16 facilitates increased purging of the scavenging passage 44 as compared to channels having top walls which are parallel to the centerline of the wrist pin aperture 19.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. An internal combustion engine comprising:

a cylinder block;

a piston housed and vertically slidable within the cylinder block;

a wrist pin aperture extending through the piston; and a piston channel located on the piston, the piston channel having a top edge wall wherein a portion of the top edge wall is sloped towards the wrist pin aperture up to an intersection formed between the top edge wall and an outer sidewall of the piston such that as the piston channel first opens, air is directed by the top edge wall to a top corner of a scavenging passage.

2. The internal combustion engine of claim 1, wherein the piston channel extends radially inward partially around a circumference of the piston and is shaped such that the top edge wall is sloped upward in an outward radial direction.

3. The internal combustion engine of claim 1, wherein the top edge wall is sloped such that an open time between the piston channel and a scavenging port is increased.

4. The internal combustion engine of claim 1, wherein the top edge wall is sloped in a direction towards the top corner of the scavenging passage.

5. A piston for an internal combustion engine comprising:

a substantially cylindrical piston body; and a piston channel that extends circumferentially around a portion of the piston body and is shaped such that a portion of an edge wall is sloped towards a wrist pin aperture located in the piston up to an intersection formed between the edge wall and an outer sidewall of the piston such that as the piston channel first opens, air is directed by the edge wall to a top corner of a scavenging passage.

6. The piston of claim 5, wherein the edge wall of the piston channel is tapered.

7. The piston of claim 5, wherein the edge wall of the piston channel is angled from about ten degrees to about sixty degrees from an axis parallel to a centerline of the wrist pin aperture.

* * * * *